United States Patent [19]

Tetzner

[11] 4,022,027

[45] May 10, 1977

[54] MARINE STRUCTURES

[76] Inventor: Siegfried K. Tetzner, 5307 W. Lake Shore Drive, Wonder Lake, Ill. 60097

[22] Filed: June 16, 1975

[21] Appl. No.: 587,163

[52] U.S. Cl. ..... 61/65

[51] Int. Cl.[2] ..... B63C 1/00

[58] Field of Search ..... 61/64, 65, 66, 67; 114/44; 214/1 R, 1 A

[56] References Cited

UNITED STATES PATENTS

| | | | |
|---|---|---|---|
| 2,505,832 | 5/1950 | Lange | 61/65 |
| 2,863,293 | 12/1958 | Plumer | 61/65 X |
| 3,220,196 | 11/1965 | Schollard | 61/65 |
| 3,221,899 | 12/1965 | Gronlund | 61/64 X |
| 3,753,355 | 8/1973 | Knoch | 61/65 |

*Primary Examiner*—Paul R. Gilliam
*Assistant Examiner*—David H. Corbin
*Attorney, Agent, or Firm*—Wegner, Stellman, McCord, Wiles & Wood

[57] ABSTRACT

Marine structures adapted to be installed in relatively shallow bodies of water, such as for use in storing boats and in defining pier structures. The marine structures are arranged to be stored subjacent the water surface during winter months and more specifically, below the freeze zone of the body of water in which they are placed, thereby to avoid movement of the structures resulting from movement of the ice on the water surface. The structures are selectively positionable in a normal use arrangement and in a retracted storage arrangement, as desired. The marine structures may include boat stations, pier.structures, and the like.

14 Claims, 6 Drawing Figures

MARINE STRUCTURES

BACKGROUND OF THE INVENTION

1. Field of the Invention

This invention relates to marine structures and in particular to structures such as boat stations and piers.

2. Description of the Prior Art

In conventional marine structures, such as boat stations and piers, adapted for installation at the shore of a body of water, such as a lake or river, a submerged portion of the structure is provided resting on the marine bottom and extending upwardly therefrom to above the surface of the water.

In the conventional boat station, the structure includes a hoist portion which is movable vertically between a boat receiving position and a boat raising position, such as for storing the boat out of the water. Handwheel or electric motor means may be provided for effecting the desired movement of the movable portion of the boat station suitably geared to permit a person to move the relatively heavy boat between the floating and storage positions.

Similarly, in conventional pier constructions, footings are placed in the water extending down to the bottom for supporting a deck above the upper surface of the water.

Conventionally, such boat stations and piers must be removed each winter to avoid damage thereto by ice movement on the surface of the body of water during the winter months.

A number of structures have been developed wherein the portion of the structure extending to above the water level may be stored below the water level when desired. More specifically, as shown in Russel B. Smith U.S. Pat. No. 3,216,704, a boat hoist is provided having a boat support portion which is pivotally retractable to below the normal water level, when desired. An upright is provided carrying a winch for controlling the retractable support portion. The winch mounting means is maintained extending to above the water level at all times and, thus, the Smith patent presents the problem discussed above of having one or more portions of the marine structure extending to the ice level whereby movement of the ice during the winter months may damage and move the marine structure. There is no teaching in the Smith patent of any specific disposition of the hoist in the retracted position relative to the exposed ice depth.

In U.S. Pat. No. 2,505,832 of Anthony C. Lange, a boat hoist is shown which is retractable to below the water line by means of a pump.

U.S. Pat. No. 3,753,355 of Glen C. Knoch, shows a boat hoist provided with a winch and cable means for pivoting an upper boat support portion on a lower frame. The winch portion is similar to that of Smith in extending to above the water level at all times.

Byron L. Godbersen, in U.S. Pat. No. 3,169,644, teaches the provision of means for mounting automobile tire wheels on the boat hoist permitting it to be moved more readily into and from the water so that the structure may not only serve as a boat hoist, but as a trailer.

Other prior art patents showing generally the use of similar boat handling apparatus are those of Hiram L. Sarver U.S. Pat. No. (1,369,194), David M. Murphy U.S. Pat. No. (2,934,220), Edward E. Harvey U.S. Pat. No. (3,021,965), and Harry W. Schollard U.S. Pat. No. (3,220,196).

Sarver U.S. Pat. No. 1,369,194 shows an automobile lift but does not even remotely suggest a marine installation similar to applicant's installation. Murphy U.S. Pat. No. 2,934,220 shows a boat lifting device which is simmilar to the Knoch patent in providing a structure having at least one portion which would extend to above the water level at all times. Edward E. Harvey U.S. Pat. No. 3,021,965 shows a retractable boat lift without any teaching of the relationship thereof to the freeze zone in a marine installation, and Schollard U.S. Pat. No. 3,220,196, shows a boat dock without any relationship to the freeze zone of a marine body of water.

SUMMARY OF THE INVENTION

The present invention comprehends an improved marine structure, such as a boat station or pier, having a base frame adapted to be seated on a marine bottom with an upper portion thereof disposed substantially below the upper surface of the water. A lift frame is provided for supporting the boat where the marine structure comprises a boat station, and a pier deck is provided where the marine structure comprises a pier structure.

The invention comprehends providing means for movably mounting the lift frame or pier deck to the base frame preselected to dispose the lift frame or pier deck in a winter storage position a distance below the water upper surface preselected to be subjacent the freeze zone of the water whereby shifting of ice in said freeze zone is effectively precluded from shifting the marine structure in the winter storage position.

Thus, the present invention eliminates the need for removing the marine structure once it is installed in the body of water in the desired position, saving substantial costs and effort as occur in the handling of conventional marine structures of this type, as discussed above.

The boat station lift frame may be relatively narrow permitting close storing of boats by a plurality of such boat stations.

The marine structures are arranged to be collapsed to a low height in the winter storage position and, illustratively, may have a height of less than approximately 12 inches.

The preselected distance below the water surface to which the structure is brought in the winter storage position is a function of the exposed depth of the ice zone of the body of water in which the marine structure is placed. It has been found that, in conventional installations such as in the northern United States, a preselected distance of approximately 20 inches or more is sufficient to dispose the marine structure below the ice zone for safe storage as discussed above.

The boat station may be provided with a retractable winch frame which is also adapted to be stored below the freeze zone with the lift frame. The boat station may be designed for handling selected loads as desired, and may include either manual or motor driven winch means as desired.

The lift frame may be provided with suitable guides and keel blocks, which may be removably carried thereon as desired.

Illustratively, the boat station may have a width of approximately 60 inches for handling boats up to 3600 lbs. The base frame may have outwardly flaring legs for improved stability with the lower end of the legs spaced apart up to 90 inches while yet permitting the installation of the boat station on 60-inch centers, as desired.

The retraction and raising of the marine structure between the operative and winter storage positions may be effected by a single person within a short period of time, thereby substantially facilitating the winter storage and summer usage arrangements of the apparatus.

The apparatus may be made of welded structure units with the movable elements movable on pivot axles controlled by friction cushions and spring loaded locking pins.

The apparatus is relatively simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figure 1:
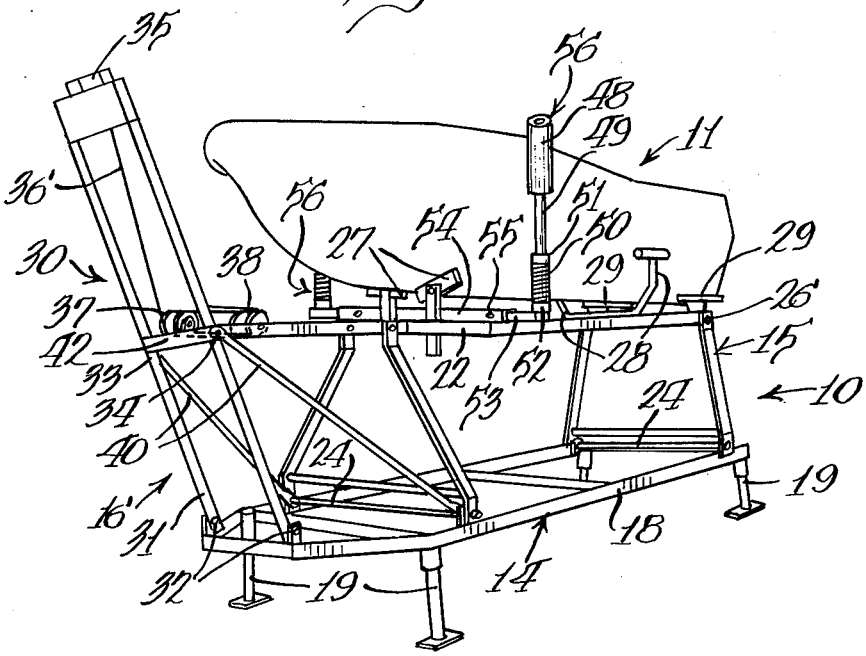
FIG. 1 is a perspective view of a marine structure embodying the invention, comprising a boat station.
Figure 2:
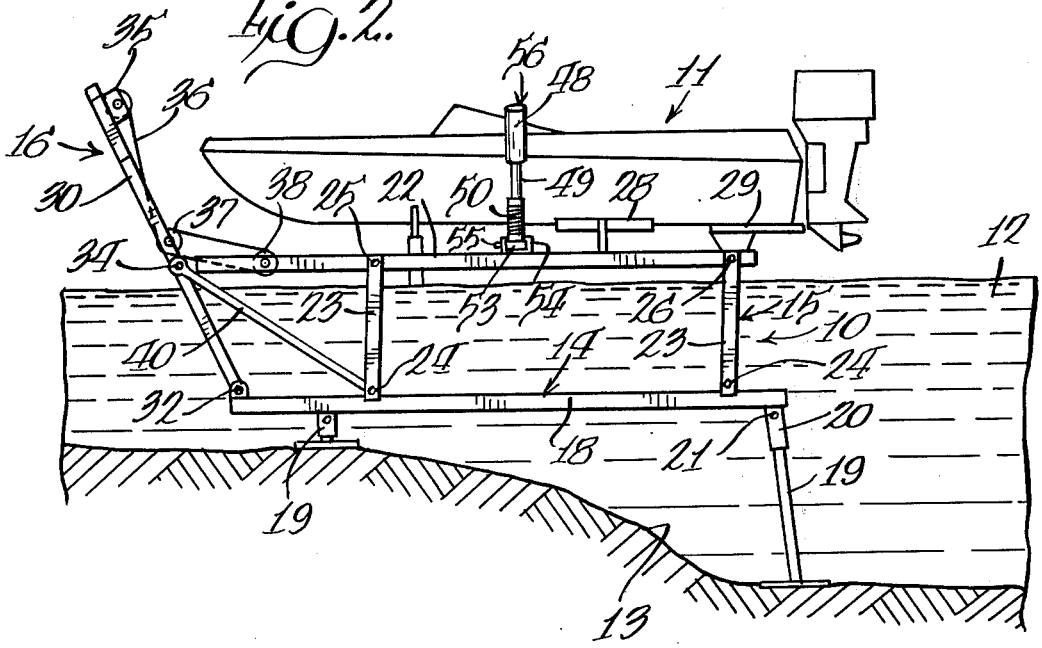
FIG. 2 is a side elevation thereof as installed on a marine bottom with the boat in the above-water summer storage position.
Figure 3:
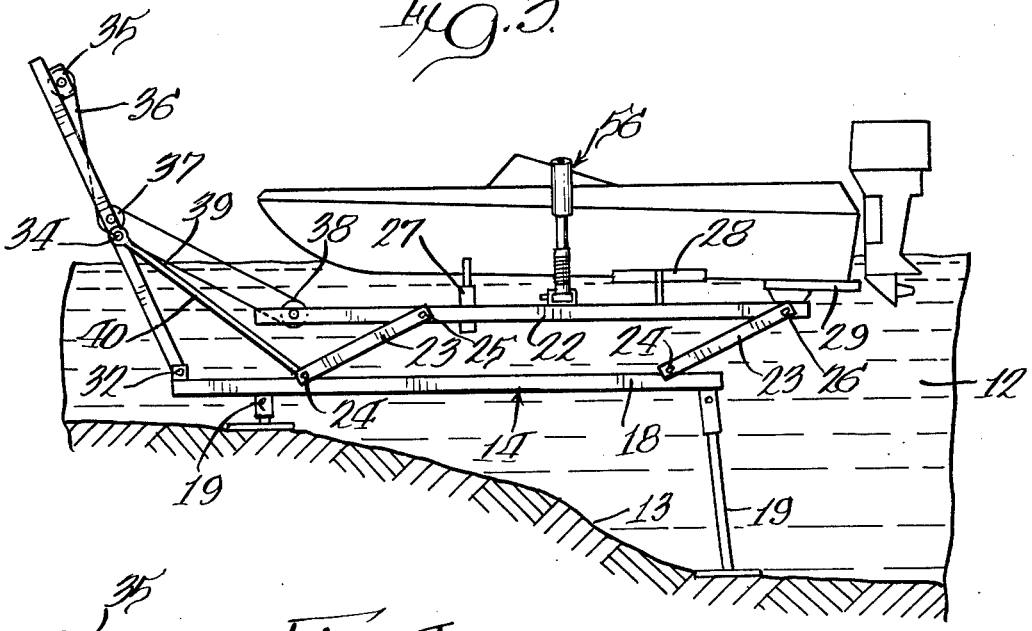
FIG. 3 is a side elevation illustrating the lowering of the boat to the floating position.
Figure 4:
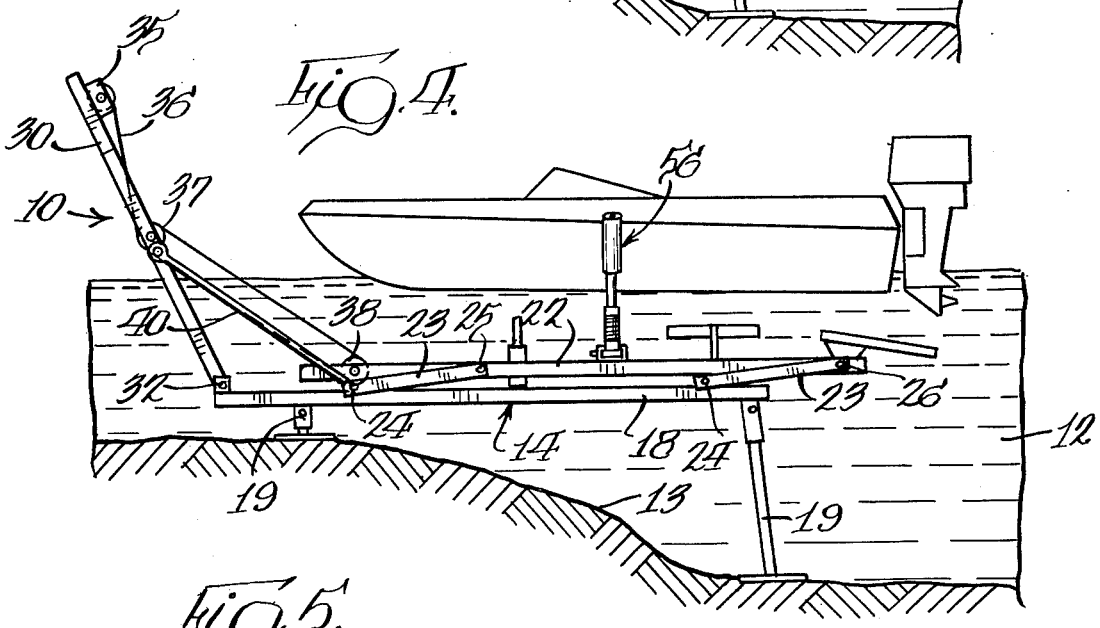
FIG. 4 is a side elevation illustrating the arrangement of the boat station in a retracted position permitting floating of the boat from and to association with the boat station.
Figure 5:
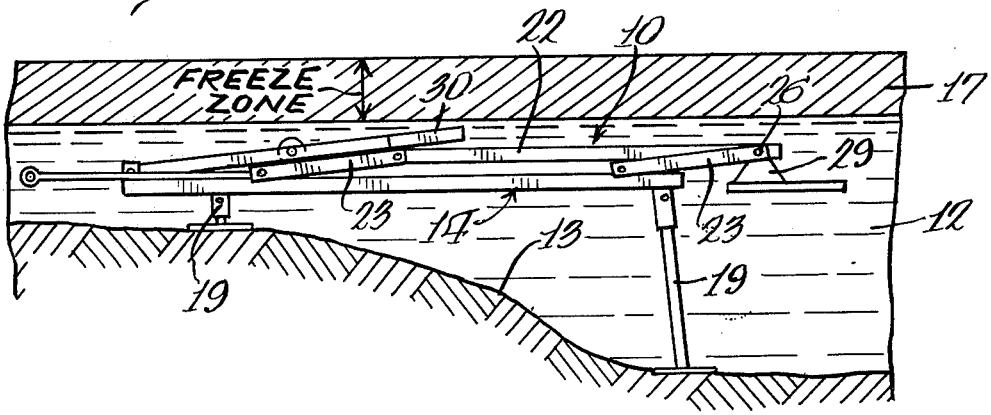
FIG. 5 is a side elevation illustrating the winter storage arrangement of the boat station below the ice zone.

In the exemplary embodiment of the invention as shown in FIGS. 1–5 of the drawing, a marine structure generally designated 10 is shown to comprise a boat station adapted for controlling the storage of a boat 11 relative to a body of water 12 defining a bottom 13 on which the boat station is adapted to rest. The boat station includes a base frame generally designated 14 and a lift frame generally designated 15. Means generally designated 16 are provided for selectively disposing the lift frame in a submerged boat docking position, as illustrated in FIG. 4, in a raised boat supporting position, as illustrated in FIG. 2, and in a retracted winter storage position, as illustrated in FIG. 5.

More specifically, as shown in FIG. 5, the boat station is adapted to be stored subjacent the ice zone 17 of the water body 12 in the winter storage position, thereby effectively preventing damage to the boat station and shifting of the boat station on the bottom 13 by movement of ice in the ice zone 17. Thus, the present invention comprehends the provision of such a marine structure which need not be removed from the water body 12 once it is installed and which thus avoids the costly and time consuming removal and reinstallation of conventional boat stations.

As shown in FIG. 1, the boat station base frame 14 may be formed of suitable steel girders 18 which may be secured in the frame configuration by suitable welds. A plurality of legs 19 depend from the base frame to rest on the bottom 13, as shown in FIG. 2, with the legs being vertically adjustable in suitable tubular guides 20 mounted to the base frame and locked in position by suitable pins 21 extended through the legs and guides 20 to position the base frame generally horizontally, as shown in FIG. 2.

The lift frame 15 may include an upper support portion 22 swingably connected to the base frame 14 by links 23 each having a lower end pivotally connected to the base frame by suitable axles 24 and to the lift frame 15 by suitable axles 25 and 26.

As shown in FIG. 1, the support frame 22 may be provided with a plurality of keel blocks 27 and a plurality of guides 28 for facilitating accurate centering of the boat 11 on boat station 10. A pair of stern rests 29 may be provided at the rear of support frame 22 for supporting the stern of the boat on the boat station in the elevated position of FIG. 2.

As best seen in FIG. 1, lift frame 15 is relatively thin and preferably has a width no greater than the width of boat 11 to permit close docking of a plurality of boats alongside of each other by means of a plurality of such boat stations. The base frame 14 may be relatively wide, such as up to 60 inches or more, to permit handling of a wide range of different size boats with improved stability. As legs 19 flare out, the spacing of the legs at the lower ends may be greater than the width of the base frame and, illustratively, the lower ends of the legs may be spaced apart up to 90 inches or more. Where such wide spacing is utilized and close docking is desired, the leg positions may be staggered so as to juxtapose the base frames notwithstanding the wider spacing of the support legs.

As further shown in FIG. 1, the boat station further includes a winch frame 30 comprising a portion of the station manipulating means 16. The winch frame has a lower portion 31 pivotally secured to the base frame on pivots 32.

Winch frame 30 removably carries a conventional winch 35 provided with a cable 36 trained over a first set of pulleys 37 on the winch frame and a second set of pulleys 38 on the lift frame distal end 39 connected to a crossbar 42 on the winch frame.

The winch frame is supported at a forwardly inclined angle, as seen in FIG. 2, by a pair of struts 40 having one end connected to the base frame 14 by axle 24 and the opposite end connected to the winch frame by connectors 41. When struts 40 are thusly secured to the frames, the winch frame is positively locked in the forwardly inclined position at the front of the boat station for facilitated control of the disposition of the lift frame by suitable operation of winch 35.

Winch 35 may comprise a worm gear means which effectively locks the lift frame with boat 11 carried thereon in the upper raised position of FIG. 2 so as to maintain the boat stored out of the body of water 12 for improved temporary storage thereof. When it is desired to lower the boat into the water, winch 35 is suitably operated to pay out cable 36, permitting the lift frame to swing on links 23 in a clockwise direction, as seen in FIGS. 2 and 3, bringing the lift frame to below the upper surface of the water and permitting the boat to float on the water, as shown in FIG. 3. Further lowering of the lift frame to the position of FIG. 4 frees the boat fully from the boat station for suitable use of the boat on the body of water, as desired.

In returning the boat to the storage position, the user need merely bring the boat into the overlying position relative to boat station 10 illustrated in FIG. 4, and with the boat so positioned, for the suitable operation of winch 35 to raise the lift frame to the position of FIG. 3 wherein keel blocks 27, guides 28 and stern rests 29 suitably engage the boat bottom to provide a centered support of the boat permitting the boat to be raised further from the water to the storage position of FIG. 2.

As indicated above, the invention comprehends the selective disposition of boat station 10 in a winter storage position, such as shown in FIG. 5, wherein the boat station is disposed fully below the ice zone 17 of the water body 12. Thus, where the ice zone may have a thickness of approximately 20 to 24 inches, such as in most areas in the northern United States, the boat station is adapted to be disposed at least 20 to 24 inches below the upper surface of the water in the boat storage position. To place the boat station in the boat storage position, the user need merely disconnect the forward end of the struts 40 from winch frame 30 and remove winch 35 and cable 36 whereupon the boat station may swing to the lowermost retracted position of FIG. 5. Keel blocks 27 and roller guides 28 may be removed, if desired, prior to the lowering of the boat station to the winter storage position. As shown in FIG. 5, stern rests 29 may be pivotally connected to the axle 26 permitting them to be swing to a depending position, as desired.

Thus, boat station 10 effectively permits maintained disposition thereof in the body of water at all times notwithstanding the placement of the boat station in a body of water which freezes over during the winter months. The invention comprehends an arrangement of the boat station structure suitably to cause the entire structure remaining in the water to retract to a position below the expected ice zone so as to effectively avoid damage to the winter stored boat station and movement of the stored boat station away from the placement thereof on the water body bottom. Such an arrangement substantially reduces maintenance and handling costs and provides a substantially improved facilitated boat storage control means.

To stabilize the boat on the lift frame supports, the boat station may be further provided with side guide means including a pair of side guides 56 disposed at opposite sides of the boat, as shown in FIG. 1. Each side guide includes a pair of side rollers 48 rotatably carried on the upper end of a tubular upright 49 having its lower end connected to a coil spring 50 by a bracket 51. The lower end of spring 50 is connected by a bracket 52 to a projecting outer end of a support tube 53 which is longitudinally movably carried in a carrier tube 54 secured to the support portion 22 of the lift frame to extend transversely thereacross. The support tube is locked in the desired position in carrier tube 54 by a suitable set screw 55.

The support tube 53 and carrier tube 54 are preferably of noncircular cross section and illustratively may comprise square tubing. The support tube 53 of each side guide 56 may be withdrawn from the carrier tube 54 in placing the boat station in condition for winter storage. This is simply effected by loosening the set screw 55. If desired, the side guides may be retained on the lift frame 15 by reinstalling the support tube 53 in the end of the carrier tube 54 with the upright 49 extending horizontally so that the entire side guide is disposed horizontally substantially at the top of the lift frame.

Figure 6:
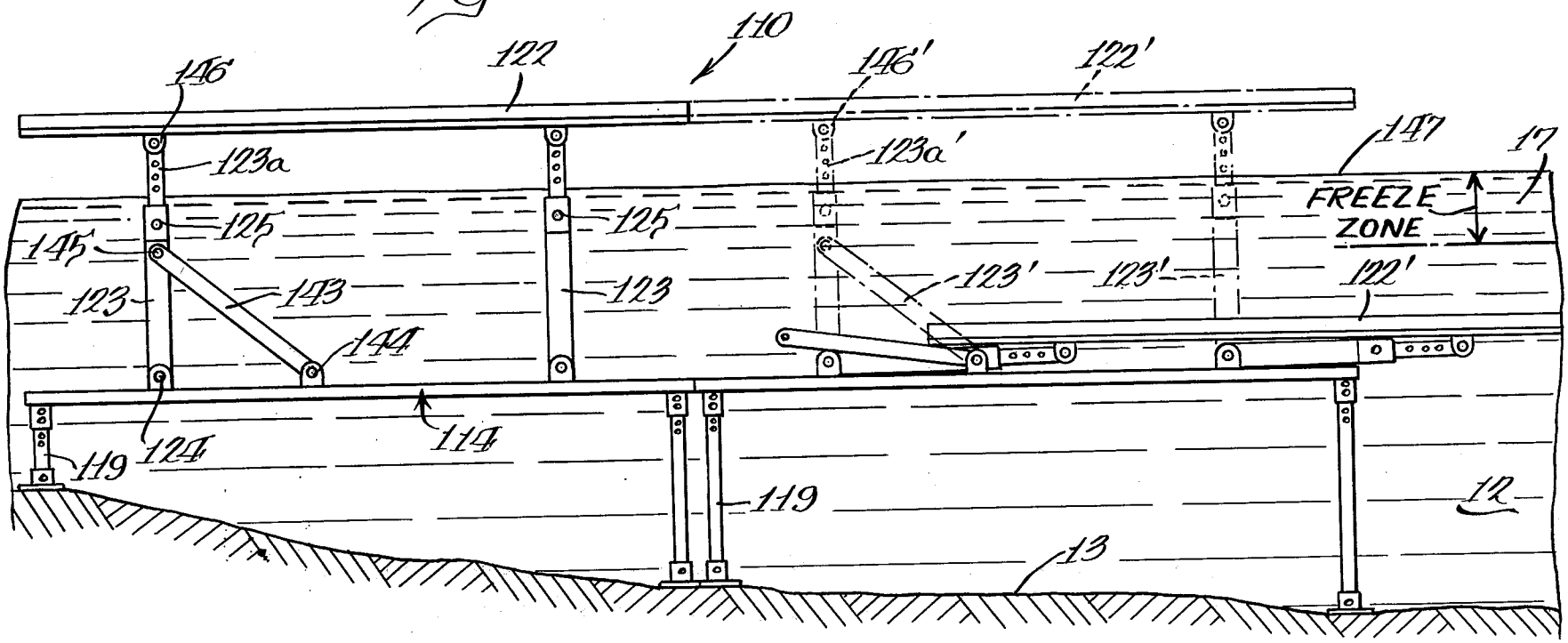
FIG. 6 is a side elevation of a pier structure embodying the invention with one portion thereof in the extended use arrangement and with a second portion thereof in a winter storage retracted arrangement below the freeze zone of the water body.

Referring now to FIG. 6, the structural concepts of the boat station form of marine structure may be similarly utilized in other marine structures, such as pier structure generally designated 10. Thus, the pier structure may include a plurality of decks 122 swingably carried on the base frame 114 by means of links 123 and 123'. The base frame may be provided with suitable legs 119 for supporting the base frame on the water body bottom 13 as in boat station 10. The deck may be carried on an upper extension portion **123*a* (and 123*a'*) of links 123 and 123' which may be suitably adjusted by means of axles 125. The links may be retained in the vertical position by suitable struts 143 having a lower end connected to the base frame by a pivot 144 and an upper end connected to the link by a pivot 145. The upper end of the link extension 123*a* may be pivotally connected to the deck 122 by a pivot 146**.

The link extension **123*a* are suitably positioned in the links 123 and secured to position the deck 122 at the desired height above the upper surface 147 of the water body 12. The links are maintained substantially in the vertical position by the struts 143** to provide a firm support of the deck in the pier construction.

However, when it is desired to re-arrange the pier for winter storage, the user need merely disconnect struts 143 from the pivot 145, thereby permitting the deck to be swung downwardly from the pier forming arrangement to a retracted winter storage arrangement adjacent base frame 114, as illustrated by the full line disposition of deck 122' at the right portion of the pier, as seen in FIG. 6. In effecting such repositioning, links 123 swing on lower pivot axles 124 carried on the base frame for facilitated repositioning thereof. Such lowering may be effected manually, as desired.

To reposition the pier structure in the pier defining arrangement at the end of the winter season, the user need merely swing the deck portions upwardly on the pivot axles 124 and reconnect the struts 143 to the links 123 by the pivot connections 145. Thus, during the winter months, the pier remains in the body of water 12 below the freeze zone 17 so as to effectively prevent damage and movement of the pier by the action of the ice in freeze zone 17. The repositioning of the pier both to and from the winter storage position is effected with minimum expense and time and, thus, pier structure 110 provides a further improved marine structure embodying the invention.

The foregoing disclosure of specific embodiments is illustrative of the broad inventive concepts comprehended by the invention.

I claim:

1. In a marine installation in a body of water having an upper surface, a bottom, and an upper freeze zone extending downwardly from said upper surface up to a predetermined maximum depth, a boat station comprising: a lift frame for supporting a boat; a base frame having legs adapted to be seated on said bottom and having an upper portion disposed at least said depth below said upper surface of the water when the legs are seated on said bottom; means for selectively disposing said lift frame on said base frame in (a) a submerged, boat docking position, (b) a raised boat storage position wherein a boat supported therein is raised above said water upper surface, and (c) a winter storage position below said freeze of the water; a winch frame; and means for movably mounting the winch frame to said base frame for selective disposition in (d) a winching position wherein said winch frame may removably carry a winch above said water upper surface, and (e) a water storage position at least said freeze zone depth below said water upper surface, whereby shifting of ice in said freeze zone is effectively precluded from shifting said boat station in the winter storage position.

2. The boat station of claim 1 wherein said freeze zone depth is at least approximately 20 inches.

3. The boat station of claim 1 wherein said legs are vertically adjustable.

4. The boat station of claim 1 wherein said means for selectively disposing the lift frame includes means swingably mounting the lift frame to the base frame.

5. The boat station of claim 1 wherein said lift frame includes removable keel blocks.

6. The boat station of claim 1 wherein said lift frame includes removable roller guides.

7. The boat station of claim 1 wherein said lift frame has a width less than approximately 72 inches.

8. The boat station of claim 1 wherein said frames have a height no greater than approximately 12 inches when the boat station is in the winter storage position.

9. In a pier installation in a body of water having an upper surface, a bottom, and an upper freeze zone extending downwardly from said upper surface up to a predetermined maximum depth, a pier deck; a base frame having legs adapted to be seated on said bottom and having an upper portion disposed at least said predetermined depth below said upper surface of the water above the bottom when the legs are seated on said bottom; and mounting means movably mounting said pier deck to said base frame to be disposed selectively in (a) a locked raised pier forming extended position wherein the deck is disposed above said water upper surface, (b) a retracted winter storage position below said freeze zone of the water whereby shifting of ice in said freeze zone is effectively precluded from shifting said pier structure in the winter storage position, said mounting means including connecting means permitting selectively mounting of the deck on the base.

10. The pier structure of claim 9 wherein said mounting means comprises leg means pivotally mounted to said base frame.

11. The pier structure of claim 9 wherein said mounting means comprises leg means pivotally mounted to said base frame and said deck.

12. The pier structure of claim 9 wherein said mounting means comprises leg means pivotally mounted to said base frame and brace means removably connected between said legs and said base frame for locking the pier deck in the raised pier forming position.

13. The pier structure of claim 9 wherein said mounting means comprise legs each having an upper portion, a lower portion, and means for locking said portions in aligned relationship to define a rigid leg having a preselected length suitable to dispose said pier deck a preselected distance above said upper water surface in the raised position.

14. The pier structure of claim 9 wherein the disposition of said deck in said retracted position is at least approximately 20 inches below the disposition thereof in said extended position.

* * * * *